US009994296B1

(12) United States Patent
Balogh et al.

(10) Patent No.: US 9,994,296 B1
(45) Date of Patent: Jun. 12, 2018

(54) DEVICE AND METHOD FOR PROVIDING USER INPUT CONTROL ON A MARINE VESSEL

(71) Applicant: Brunswick Corporation, Lake Forest, IL (US)

(72) Inventors: Daniel J. Balogh, Menasha, WI (US); Brian J. Poirier, Fond du Lac, WI (US); Scott M. Westpfahl, Oshkosh, WI (US); Suresh Venigalla, Sun Prairie, WI (US)

(73) Assignee: Brunswick Corporation, Mettawa, IL (US)

( * ) Notice: Subject to any disclaimer, the term of this patent is extended or adjusted under 35 U.S.C. 154(b) by 11 days.

(21) Appl. No.: 15/294,198

(22) Filed: Oct. 14, 2016

(51) Int. Cl.

| | |
|---|---|
| ***B63H 21/21*** | (2006.01) |
| ***B63H 25/02*** | (2006.01) |
| ***G05G 5/03*** | (2008.04) |
| *B63J 99/00* | (2009.01) |

(52) U.S. Cl.
CPC ..... *B63H 21/213* (2013.01); *B63H 25/02* (2013.01); *G05G 5/03* (2013.01); *B63H 2025/022* (2013.01); *B63H 2025/026* (2013.01); *B63J 2099/006* (2013.01)

(58) Field of Classification Search
CPC ..... B63H 21/213; B63H 25/02; G05G 5/03
See application file for complete search history.

(56) References Cited

U.S. PATENT DOCUMENTS

| | | | |
|---|---|---|---|
| 6,138,596 | A | 10/2000 | Gonring et al. |
| 6,273,771 | B1 | 8/2001 | Buckley et al. |
| 6,468,117 | B1 | 10/2002 | Healey |
| 6,507,164 | B1 | 1/2003 | Healey et al. |
| 7,104,857 | B1 | 9/2006 | Swan et al. |
| 7,112,107 | B1 | 9/2006 | Torgerud |
| 7,465,200 | B2 | 12/2008 | Mizutani |
| 9,103,287 | B1 | 8/2015 | Arbuckle et al. |
| 9,272,764 | B2 | 3/2016 | Bamba |
| 2011/0160964 | A1* | 6/2011 | Obradovich ..... G06F 17/30315 701/41 |

OTHER PUBLICATIONS

Andrasko et al, "Drive-By-Wire Control Systems and Methods for Steering a Marine Vessel", Unpublished U.S. Appl. No. 15/190,620, filed Jun. 23, 2016.
Better, "Lockout for Remote Controls on Marine Vessels", Unpublished U.S. Appl. No. 14/992,513, filed Jan. 11, 2016.

* cited by examiner

*Primary Examiner* — Basil T. Jos
(74) *Attorney, Agent, or Firm* — Andrus Intellectual Property Law, LLP

(57) ABSTRACT

A user input device for controlling steering and/or propulsion of a marine vessel includes a movable member movable by a vessel operator to control the steering and/or propulsion of the marine vessel, a variable resistance device controllable to vary resistance to movement of the movable member, and a controller that controls the variable resistance device. The controller is configured to detect an unstable condition indicator and, upon detecting the unstable condition indicator, control the variable resistance device to increase resistance to movement of the movable member.

20 Claims, 7 Drawing Sheets

DEVICE AND METHOD FOR PROVIDING USER INPUT CONTROL ON A MARINE VESSEL

FIELD

The present disclosure generally relates to user input devices and methods for providing user control of a marine vessel, and more specifically for providing user control of steering and/or propulsion of a marine vessel.

BACKGROUND

U.S. Pat. No. 6,138,596, incorporated by reference herein in its entirety, discloses a hydraulic damper for a steering system, such as that of a boat or watercraft. A manually movable steering mechanism, such as a steering wheel, is connected to a piston and cylinder combination in such a way that rotation of the steering wheel causes relative movement between the piston and cylinder. Hydraulic fluid is disposed within the cylinder in such a way that movement between the cylinder and piston requires the hydraulic fluid to move from one portion of the cylinder to another portion of the cylinder. This fluid movement is conducted through a conduit which can be external to the cylinder or internal to the cylinder and extending through the piston.

U.S. Pat. No. 6,273,771, incorporated by reference herein in its entirety, discloses a control system for a marine vessel that incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 6,468,117, incorporated by reference herein in its entirety, discloses a foot control unit for controlling the directional orientation of a trolling motor. The foot control unit includes an upper pivotal foot pedal and a lower flat base member to which the foot pedal is pivotally attached. The foot control unit further includes an offset hinge consisting of an upper hinge member pivotally attached at a first end thereof to the foot pedal and a lower hinge member pivotally attached at a first end thereof to the base member, the hinge members being pivotally attached to each other at respective ends thereof which are opposite from said first ends thereof, and a detent mounted on the offset hinge unit and responsive to a predetermined degree of pivotal movement of the upper hinge member with respect to the lower hinge member to provide a temporary stop in the pivotal movement.

U.S. Pat. No. 6,507,164, incorporated by reference herein in its entirety, discloses a trolling motor having current based power management including: an electric motor; a motor controller having an output for providing voltage to the motor; and a current sensor for measuring the electrical current flowing through the motor. Upon determining that the trolling motor has been operating above its continuous duty limit for a predetermined period of time, the motor controller begins reducing the voltage output to the motor until reaching an acceptable output voltage. In another embodiment, the controller is operated in three distinct modes with three distinct sets of operating parameter, namely: a normal mode wherein the output is set to a commanded level; a current limit mode wherein the output is set to a safe, predetermined level; and a transitional mode wherein the output is incrementally changed from the predetermined level to the commanded level.

U.S. Pat. No. 7,104,857, incorporated by reference herein in its entirety, discloses a transmission for a marine propulsion system using a cone clutch in such a way that, when in a forward gear position, torque is transmitted from an input shaft, or driving shaft, to an output shaft, or driven shaft, solely through the cone clutch. When in forward gear position, driving torque between the driving and driven shafts is not transmitted through any gear teeth. When in reverse gear position, torque is transmitted through an assembly of the bevel gears.

U.S. Pat. No. 7,104,857, incorporated by reference herein in its entirety, discloses a hydraulically assisted steering system that provides a controller which activates a hydraulic pump when a manual throttle selector handle is in either forward or reverse gear selector positions, but deactivates the pump when the handle is in a neutral gear selector position. A controller can also interrogate an ignition key to make sure that it is in an ON position and also respond to the activation of a manual switch which can be used to override the deactivation step of the pump.

U.S. Pat. No. 7,112,107, incorporated by reference herein in its entirety, discloses a haptic throttle control mechanism that includes a vibrating element that is connected in vibration transmitting relation with the control mechanism. The vibrating element can be a motor with an eccentric weight attached to its shaft or a piezoceramic component. The vibrating signal can be used to provide information to the operator of the marine vessel relating to the actual operating speed of the engine or, alternatively, it can be used to alert the operator of an alarm condition.

U.S. Pat. No. 9,103,287, incorporated by reference herein in its entirety, discloses drive-by-wire control systems and methods for a marine engine utilizing an input device that is manually positionable to provide operator inputs to an engine control unit (ECU) located with the marine engine. The ECU has a main processor that receives the inputs and controls speed of the marine engine based upon the inputs and a watchdog processor that receives the inputs and monitors operations of the main processor based upon the inputs. The operations of the main processor are communicated to the watchdog processor via a communication link. The main processor causes the watchdog processor to sample the inputs from the input device at the same time as the main processor via a sampling link that is separate and distinct from the communication link. The main processor periodically compares samples of the inputs that are simultaneously taken by the main processor and watchdog processor and limits the speed of the engine when the samples differ from each other by more than a predetermined amount.

U.S. Pat. No. 9,272,764, incorporated by reference herein in its entirety, discloses a remote control device for a vessel that is installed in a vessel and remotely controls a vessel propulsion device of the vessel. The remote control device includes an operation member, an operation load applying mechanism, a control section, and an actuator. The operation member is supported rotatably around a rotation axis, and is operated by an operator to switch the shift position of a forward-reverse switching mechanism in the vessel propulsion device according to the operation angle of the operation member. The operation load applying mechanism applies an operation load to the operation member. The control section controls the operation load. The operation load applying mechanism includes an actuator that adjusts the operation load. The control section is arranged to control the actuator based on a vessel speed of the vessel.

Unpublished U.S. patent application Ser. No. 15/190,620, filed Jun. 23, 2016, and assigned to the Applicant of the present application, incorporated by reference herein in its entirety, discloses a drive-by-wire control system for steering a propulsion device on a marine vessel that includes a steering wheel that is manually rotatable and a steering actuator that causes the propulsion device to steer based upon rotation of the steering wheel. The system further includes a resistance device that applies a resistance force against rotation of the steering wheel, and a controller that controls the resistance device to vary the resistance force based on at least one sensed condition of the system.

Unpublished U.S. patent application Ser. No. 14/992,513, filed Jan. 11, 2016, and assigned to the Applicant of the present application, which is incorporated by reference herein in its entirety, discloses an electromechanical lockout device for a remote control on a marine vessel that includes an electric actuator and a locking pin having an engagement end and a second end. The locking pin is arranged with respect to a control lever such that the locking pin is positionable in a locked position, where the engagement end of the locking pin prevents rotation of the control lever into a reverse position, and in a retracted position, where the engagement end of the locking pin allows rotation of the control lever into the reverse position. A method of controlling lockout for a remote control includes sensing a position of a control lever, calculating a rate of change of the position, and engaging a lockout to prevent a gear system from shifting into reverse gear if the rate of change exceeds a threshold rate of change.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a user input device for controlling steering and/or propulsion of a marine vessel includes a movable member movable by a vessel operator to control the steering and/or propulsion of the marine vessel, a variable resistance device controllable to vary resistance to movement of the movable member, and a controller that controls the variable resistance device. The controller is configured to detect an unstable condition indicator and, upon detecting the unstable condition indicator, to control the variable resistance device to increase resistance to movement of the movable member.

One embodiment of a method of providing user input control for a marine vessel includes providing a user input device having a movable member movable by a vessel operator to control propulsion and/or steering of the marine vessel, the user input device including a variable resistance device that variably resists movement of the movable member. The method further includes detecting an unstable condition indicator on the marine vessel and operating the variable resistance device to increase resistance to movement of the movable member while the unstable condition indicator is detected.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
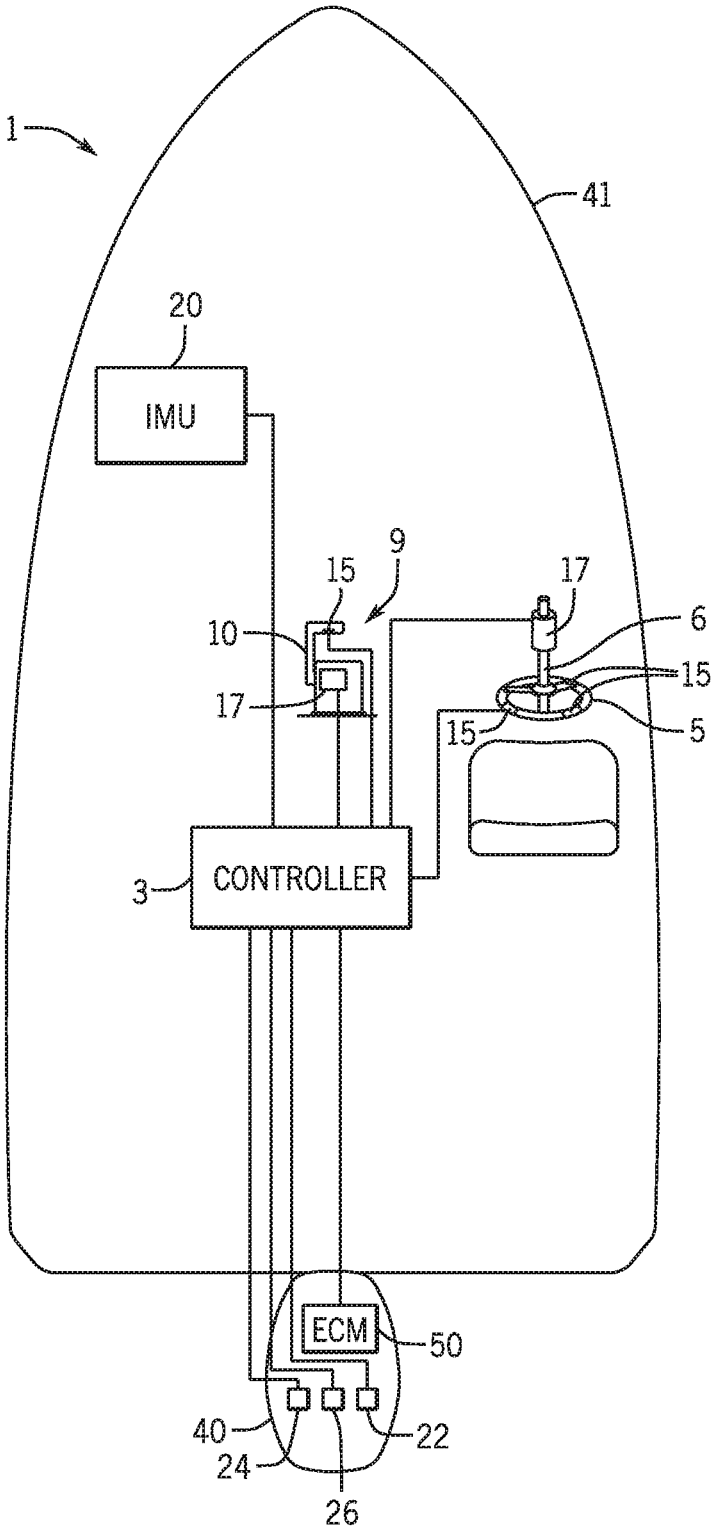
FIG. 1 is a schematic diagram of one embodiment of a system for controlling steering and propulsion of a marine vessel including user input devices.

In the present description, certain terms have been used for brevity, clarity and understanding. No unnecessary limitations are to be inferred therefrom beyond the requirement of the prior art because such terms are used for descriptive purposes only and are intended to be broadly construed.

Through experimentation, research, and development in the relevant field, the present inventors have recognized that prior art user input devices and methods for controlling steering and/or propulsion on a marine vessel do not effectively adjust to unstable conditions on a marine vessel, and thus provide an inadequate driving experience for the operator. For example, most presently available remote controls providing throttle and/or shift control on a marine vessel do not adjust to feedback from the propulsion device(s) or the environment to the operator of the marine vessel, such as from sensor devices sensing speed, inertia, position, etc. of the marine vessel.

Most presently available user input devices, such as remote controls, rely on friction built into the system from one or more of mechanical shift and throttle cables, detents, throttle return springs and linkages on the engine, or the like. Some user input devices may provide friction devices that can be manually adjusted to add a fixed amount of additional friction, such as by removing a cover of the device and tightening a screw to adjust the resistance of levers and/or detents on the input devices. However, such friction devices provide a fixed friction amount that is not adaptable during use and does not adapt automatically to changing and unstable conditions for an operator of the marine vessel.

The present inventors have recognized that a need exists for user input devices, such as a remote control and/or steering wheel, that adapt to unstable conditions on the marine vessel by stiffening, or increasing the resistance to movement. For example, the resistance on the user input devices may increase in choppy conditions, when the vessel is rocking, when the vessel abruptly accelerates, or when similar conditions occur that could challenge the operator's balance and stability on the marine vessel. This provides a better control experience for the vessel operator because the user input device has a more stable feel, allowing the operator to drive the marine vessel more comfortably in unstable conditions without worrying about inadvertent inputs due to the vessel rocking, etc.

While certain remote control systems for a vessel propulsion device have been disclosed that control the operation load in a combination throttle and shift lever to prevent gear shift when the marine vessel is travelling at high speeds equal to or higher to than a predetermined value (such as that disclosed at U.S. Pat. No. 9,272,764, which is incorporated herein).

The present inventors have recognized that remote controls that increase resistance to a shift event based on vessel speed, such as stiffening the detent, are insufficient to provide a good user experience in all conditions because vessel speed is not a comprehensive indicator of operator conditions. For example, vessel speed is not a reliable indicator of the existence of unstable conditions for the vessel operator. Unstable conditions, such as vessel rocking, can occur at low speeds. Likewise, high speeds do not necessarily mean unstable conditions. For instance, if water conditions are smooth then most vessels are very stable at the high end of their speed range.

In view of their recognition of the aforementioned need in the relevant field and the foregoing problems and shortcomings with current user input devices and methods, the inventors developed the presently disclosed systems, devices, and methods that detect one or more unstable condition indicators for the operator of the marine vessel and control a variable resistance device within the user input device to variably resist movement of the user input device based on the one or more unstable condition indicators. In various embodiments, the unstable condition indicator(s) may be based on input from an inertial measurement unit (IMU), such as detecting a threshold change in pitch, roll, yaw, or acceleration. Alternatively or additionally, the unstable condition indicator may be based on input from pressure sensors in the user input device, such as at least a threshold pressure sensed in the handle grip or on the base of the user input device—e.g. detecting force from the vessel operator's hand on the user input device that would be associated with the operator bracing or steadying themselves in unstable conditions on the marine vessel. In still other embodiments, the unstable condition indicator may be partly or wholly based on engine load and/or output torque, where an unstable condition is detected when at least a threshold change occurs in engine load or output torque, and the variable resistance device is controlled based on the change in engine load and/or output torque value.

FIG. 1 depicts one embodiment of a marine vessel 41 equipped with a system 1 for providing user input controls for steering and propulsion of the marine vessel 41. The depicted system 1 includes two user input devices, including steering wheel 5 and remote control 9 having throttle lever 10. Each user input device 5 and 9 includes a variable resistance device 17 controllable to vary resistance to movement of the moveable member—i.e. to vary resistance to movement of the throttle lever 10 on the remote control 9 and/or to vary resistance to rotation of the steering wheel 5.

The user input device may be any device having a moveable member for providing control inputs to control steering and/or propulsion on the marine vessel 41, multiple examples of which are described herein. The user input device may include any type of variable resistance device 17 that is controllable to vary resistance to movement of the moveable member. Examples of variable resistance devices 17 include any one or more of a magnetorheological (MR) device, an electric brake (such as but not limited to an electromagnetic or mechanical contact brake, an electromagnet hysteresis brake, or a permanent magnet hysteresis brake), a direct-connected servo or stepper motor, a hydraulic cylinder, a linear actuator, a mechanical friction slip clutch, or the like. Exemplary variable resistance devices 17 are described in more detail herein.

In the example shown in FIG. 1, each of the steering wheel 5 and remote control 9 user input devices include multiple pressure sensors 15 that measure pressure exerted by a vessel operator on the respective user input device 5, 9 in the region of the pressure sensor 15. The purpose of the one or more pressure sensors 15 in each user input device (e.g. steering wheel 5 and remote control 9) is to determine when the vessel operator is exerting pressure, or force, on the user input device that is associated with the vessel operator using the user input device to steady themselves or to brace against unstable conditions. For example, pressure sensors 15 may be provided in the handle grip of the throttle lever 10 or in various locations around the steering wheel 5, such as commonly gripped areas.

The pressure sensors 15 communicate the pressure measurement values to the controller 3. The controller may then determine when a threshold pressure is met or exceeded on one or more of the user input devices. The detected threshold pressure measurement can then be used as an unstable condition indicator. The controller 3 may then control the variable resistance device 17 in the user input device where the threshold pressure is sensed in order to increase resistance to movement of the moveable member (e.g. throttle lever 10 and/or steering wheel 5) of the user input device based on the pressure measurement values. For example, the resistance may be increased proportionally to the amount that the pressure measurement value exceeds the threshold pressure level.

In another embodiment, the unstable condition indicator may be based on measurement values from an inertial measurement unit (IMU) 20 that measures linear and angular motion of the marine vessel 41. For example, the IMU 20 may include one or more of a three-axis gyroscope, a three-axis accelerometer, and a three-axis magnetometer. In one embodiment, an unstable condition indicator may be a threshold change in angular position, such as a threshold change in pitch, roll, and/or yaw. In other words, and unstable condition may be detected if the measurement values from the IMU 20 indicate that the vessel is rocking or otherwise changing in angular position at a rate that would cause an unstable condition for the vessel operator. Alternatively or additionally, the unstable condition indicator may be found where the measurement values from the IMU 20 indicate that the marine vessel 41 is at least a predetermined angular position away from the horizontal and/or vertical axes—i.e., the marine vessel 41 is tilted at an angle that would provide an unstable condition for the vessel operator. Alternatively or additionally, the unstable condition indicator may be found where measurement values from the IMU 20 indicate at least a threshold level of shock or vibration occurring on the marine vessel 41 that would be associated with unstable conditions for an operator of the marine vessel 41. Alternatively or additionally, the unstable condition indicator may be found where the measurement values from the IMU 20 indicate at least a threshold change in acceleration which would indicate unstable conditions, such as a sudden acceleration or deceleration in the horizontal plane indicating that the vessel suddenly sped up or slowed down, a sudden change in acceleration in the vertical plane indicating that the marine vessel 41 is rising or falling by more than a predetermined amount, or a sudden change in angular acceleration that the vessel is rocking as described above indicating.

In still other embodiments, the unstable condition indicator may be found where a sudden change in engine load is detected, such as a change in throttle position, intake manifold absolute pressure, or intake mass flow rate in the intake manifold within the propulsion device 40. For example, the controller 3 may receive input from one or more sensors associated with the propulsion device 40 providing values that indicate engine load, such as a throttle position sensor 22, a mass air flow sensor 56, and/or a manifold absolute pressure sensor 57. The position of the throttle valve in the propulsion device 40 is varied to allow more or less air into the intake manifold of the engine. The throttle position (TP) sensor 22 senses and provides information regarding the position of the throttle valve metering air intake into the internal combustion engine in the propulsion device 40. The mass air flow (MAF) sensor 24 provides information to the controller 3 regarding the mass flow rate of air entering the engine in the propulsion device 40. For example, the MAF sensor 24 may be "hotwire" sensor located in the air duct leading to the throttle body and positioned to sense the air volume and density entering the intake manifold. The manifold absolute pressure (MAP) sensor 26 may be any type of pressure sensor capable of providing information to the controller 3 representative of manifold absolute pressure. A change in engine load on the propulsion device 40 is reflected in the values measured by the TP sensor 22, MAP sensor 26, and MAF sensor 24. For example, a sudden increase in engine load may be indicated by a sudden opening of the throttle valve and a corresponding increase in intake mass flow rate and an increase in manifold pressure. For example, such an event may be in response to a rapid increase in throttle demand by the vessel operator. Such an increase in throttle demand will be followed by a rapid acceleration of the marine vessel 41, which is likely to create an unstable condition for the vessel operator during the rapid acceleration event. Likewise, a sudden change in engine load may indicate cavitation or blowout of the propeller on the propulsion device (i.e. some or all of the propeller is above the water surface), which may precipitate a sudden change in speed and may indicate an unstable operating condition.

Alternatively or additionally, the unstable condition indicator may be determined based on an output torque value of torque output by the engine in the propulsion device 40, and such torque value may be received from the engine control module (ECM) 50. For example, the controller 3 may receive an output torque value from the ECM 50 associated with the propulsion device 40, and may detect an unstable condition indicator where at least a threshold change in output torque has occurred within a predetermined period of time. Likewise, the unstable condition indicator may be determined based on a combination of values, including two or more of those described above.

According to the present disclosure, the controller 3 is uniquely configured to detect the unstable condition indicator and control a variable resistance device 17 in one or more input devices accordingly. The variable resistance device 17 is any device operable to apply a variable resistance force to resist motion of the moveable member of the user input device. The variable resistance device 17 may include any of various types of electrical, mechanical, and/or hydraulic devices operable to variably resist (e.g. restrict and/or brake) movement of the moveable member on the user input device, several of which are listed above. For example, the variable resistance device 17 may include an electric motor or a hydraulic pump that powers a mechanical clamp or other similar device that directly or indirectly engages the moveable member in a way that resists its linear or rotational movement. Alternatively, the variable resistance device 17 may be a magnetorheological (MR) fluid device, such as an MR fluid braking mechanism, attached to the moveable member to apply a variable resistance force thereon in response to varying a magnetic field.

Figure 2:
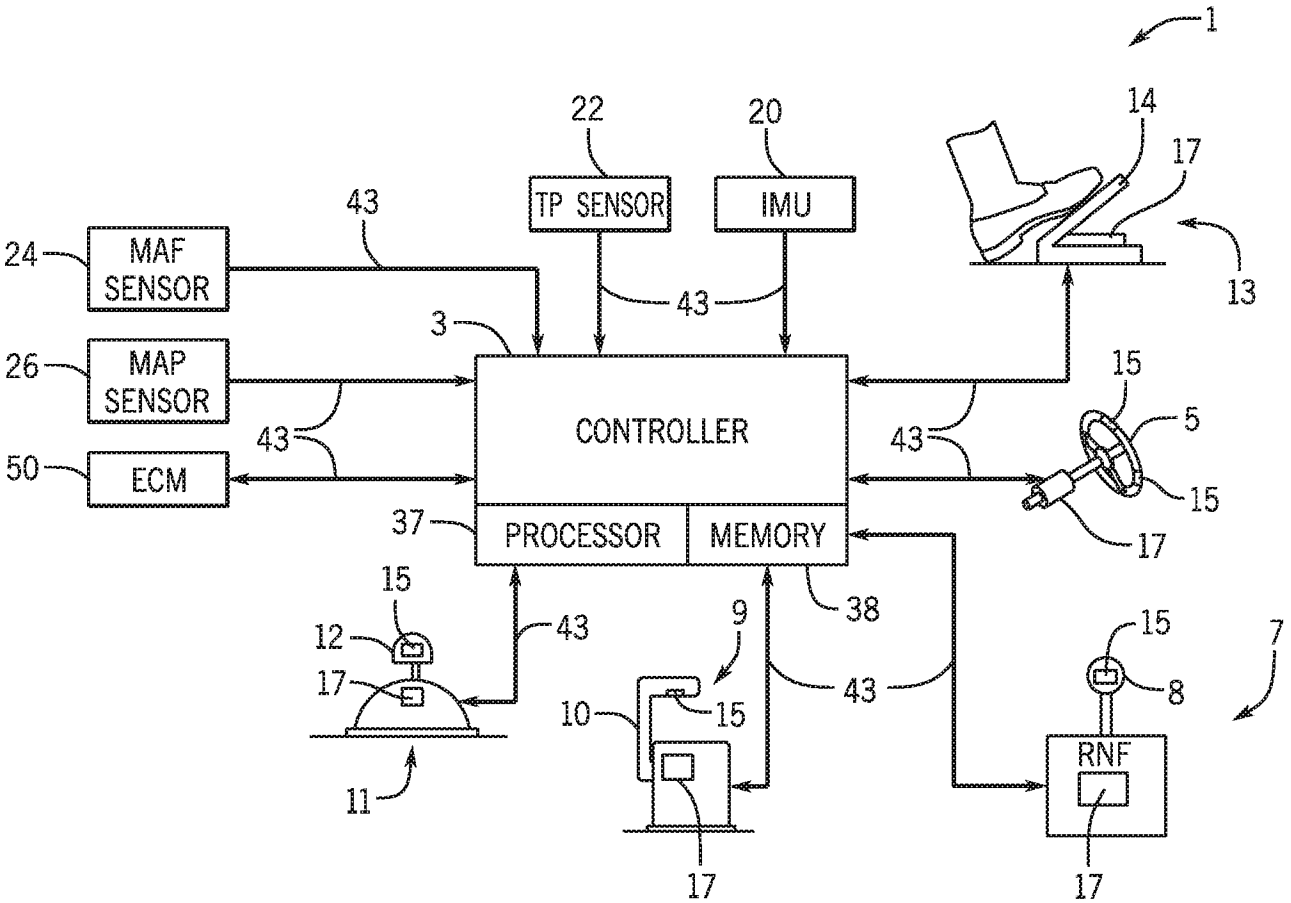
FIG. 2 is a schematic diagram of another embodiment of a system for controlling steering and propulsion of a marine vessel including several user input devices.

FIG. 2 depicts another embodiment of the system 1 including multiple user input devices for controlling steering and/or propulsion of the marine vessel 41, including a steering wheel 5, a shift device 7, a remote control 9, a joystick device 11, and a throttle foot pedal device 13. In an exemplary embodiment where the user input device is a steering wheel 5, the variable resistance device 17 may include an MR fluid braking mechanism attached to the steering shaft 6 to apply variable resistance to the rotation thereof. As will be known to a person having ordinary skill in the relevant art, MR fluid braking mechanisms transmit torque by increasing the shear stress of the fluid when the fluid is subjected to a magnetic field. The magnetic field is typically introduced by applying current to the device. By controlling the amount of current and the length of time the current is applied, the strength of the magnetic field can be controlled, thereby providing a varying amount of torque resistance.

In still other embodiments, the variable resistance device 17 on the steering wheel 5 may be a hysteresis brake. As will be known to a person having ordinary skill in the relevant art, a hysteresis brake functions by employing a hysteresis disk attached to a hub. Two or more opposing magnets are positioned on either side of the disk, and when a magnetic field is introduced, the resulting magnetic flux causes drag on the hysteresis disk. In still other embodiments, the variable resistance device 17 on the steering wheel 5 may be an electric motor and/or a hydraulic pump that powers a mechanical clamp or some other similar device that engages the steering shaft 6 with variable force to restrict, or resist, the rotation of the steering wheel 5. In still other examples, the variable resistance device 17 may include a DC motor directly coupled to the steering shaft 6 and capable of applying a braking force on the steering shaft 6 via short circuit and/or even applying a back-driving force via an H-bridge. In still other embodiments, the variable resistance device 17 may be a hydraulic circuit directly or indirectly attached to the steering shaft 6 and having a controlled orifice to restrict rotational movement thereof. For example, U.S. Pat. No. 6,138,596, which has been incorporated herein, provides one example of a hydraulically damped steering mechanism for a watercraft incorporating a hydraulic device that could be adapted to serve as a variable resistance device 17 as described herein. In still other embodiments, the variable resistance device 17 may be a clutch brake mechanism attached to the steering shaft 6 to apply a variable braking force thereon via a controlled solenoid.

A person having ordinary skill in the art will understand in light of this disclosure that those and other types of variable resistance devices 17 may be adapted and incorporated into various types of user input devices to resist movement of the movable members thereof upon detecting an unstable condition indicator. Where the user input device is a shift device 7, for example, the variable resistance device 17 variably resists movement of a shift lever 8 that instructs a transmission or clutch system to shift between a neutral position and one of a forward gear position and a reverse gear position. Where the user input device is a joystick device 11, the variable resistance device 17 variably resists movement of the joystick lever 12, which may be used to input various steering and/or propulsion commands to the propulsion device 40. Likewise, the system 1 may further include a foot pedal device 13 with a variable resistance device 17 that variably resists movement of a throttle pedal 14, which is a foot pedal pressed by the vessel operator to provide throttle control input. Exemplary foot pedal devices for providing throttle input to a propulsion device 40 on a marine vessel 41 are known in the art, such as those disclosed in U.S. Pat. Nos. 6,468,117 and 6,507,164 which have been incorporated herein, and could be adapted to include variable resistance devices as described herein.

Figure 3:
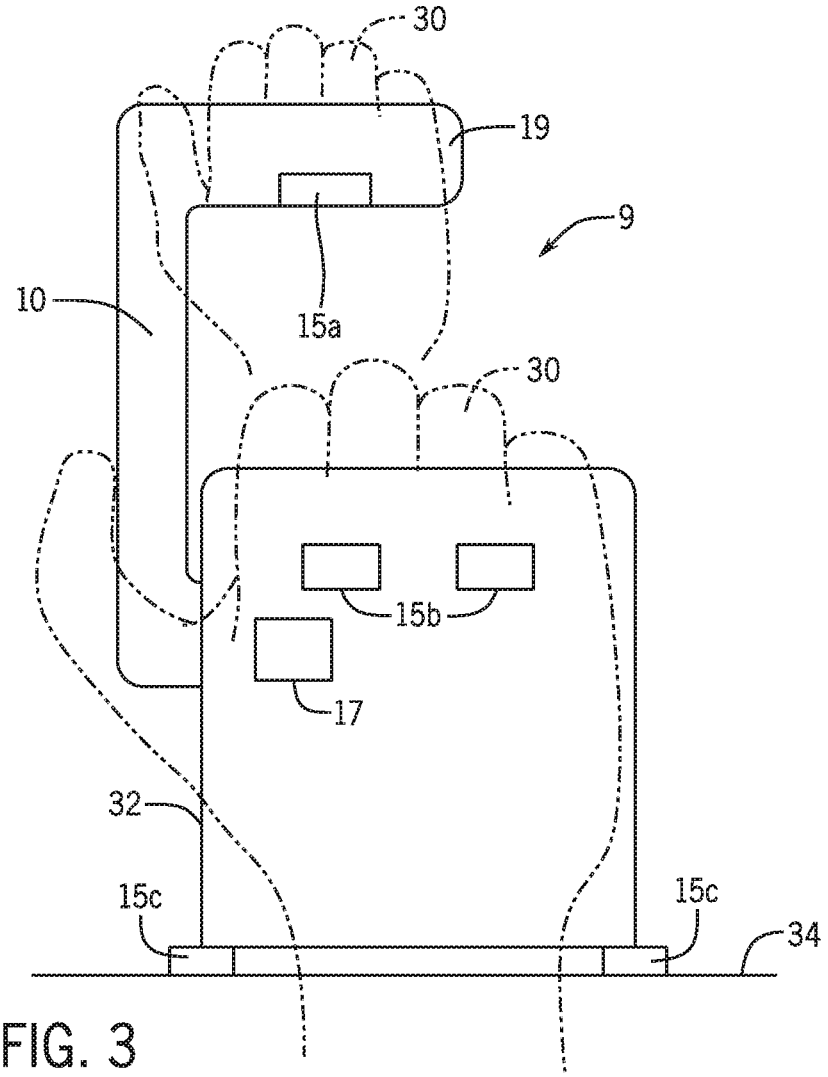
FIG. 3 depicts one embodiment of a user input device having a throttle lever in accordance with the present disclosure.

FIG. 3 depicts an exemplary remote control 9 having a throttle lever 10 operable by a user to control throttle of the propulsion device 40, and specifically to control the position of a throttle valve or an engine speed, and thus the amount of propulsion produced by the propulsion device 40. Additionally, in some embodiments the remote control 9 may be a combination throttle and gear shift control mechanism, where the position of the throttle lever also dictates whether the transmission or clutch system is in forward gear, reverse gear, or a neutral state. The throttle lever 10 extends from a base 32 which houses physical linkages, sensors, and/or electronic circuitry for translating movement of the throttle lever 10 into shift and/or throttle commands. Various embodiments of such remote controls are known in the art, and examples are provided at U.S. Pat. Nos. 7,112,107 and 9,272,764, and U.S. patent Ser. No. 14/992,513, which have been incorporated herein by reference.

In the embodiment of FIG. 3, multiple pressure sensors 15 are incorporated at various locations in the remote control 9 to sense pressure exerted by the vessel operator on portions of the remote control 9. The present inventors have recognized that it is common for vessel operators to rest the palm of their hand 30 on the base 32 when operating the remote control 9. For instance, vessel operators commonly position their thumb and index finger on either side of the bottom of the throttle lever 10 as depicted in FIG. 3. Another common occurrence is for the vessel operator to rest their hand 30 on the handle grip 19 of the throttle lever 10 with their fingers wrapped around their handle grip 19 as depicted in FIG. 3. The present inventors have recognized that when an unstable condition occurs, vessel operators utilize their hand 30 on the remote control 9 to brace themselves, placing additional force, or pressure, on the remote control 9. Accordingly, the inventors have recognized that one or more pressure sensors 15 may be strategically located at locations on the user input device where the vessel operator will rest their hand 30, and that an unstable condition can be recognized based on measurement values from the one or more pressure sensors.

For example, one or more pressure sensors 15*a* may be located within the handle grip 19 of the throttle lever 10 to detect when the vessel operator places a force on the throttle lever 10 that is associated with using the contact with the handle grip 19 to steady themselves in an unstable condition, rather than a force pattern associated with normal operation of the throttle lever 10. For instance, one or more pressure sensors 15*a* may be located on an underside of the handle grip 19, where a user performing normal throttle control operation (e.g. pushing or pulling the throttle lever 10) would not normally exert significant pressure. On the other hand, if the vessel operator were to experience unstable conditions while operating the throttle lever 10, they would likely increase their grip force on the handle grip 19, which could be sensed by the pressure sensor 15*a* on the underside of the handle grip 19.

Alternatively or additionally, one or more pressure sensors 15*b* may be located in the base 32 of the remote control to detect when the user places an increased pressure, or force, by the palm of their hand 30 on the base 32 to brace themselves against an unstable condition. One or more pressure sensors 15*b* may be located at various locations across the base 32 where the user is likely to rest their hand 30 and likely to exert force in order to brace themselves in unstable conditions. In still other embodiments, pressure sensors 15*c* may be located between the base 32 and a mounting surface 34 on which the base 32 is mounted and supported. One or more pressure sensors 15*c* may be strategically located at the connection between the base 32 and the mounting surface 34 in such a way so that forces exerted by the vessel operator's hand 30 on the base 32 are translated to and sensed by the pressure sensors 15*c*. The pressure sensors 15*a*-15*c* may be any type of sensor capable of measuring a pressure, or force, exerted by the operator's hand 30 on the relevant area of the remote control 9.

A non-limiting example of a pressure sensor applicable for this purpose is a force sensitive resistor (FSR). FSRs are available in a number of sizes, shapes, and output capabilities. FSRs are made of a conductive polymer whose resistance changes in a predictable manner when a force or pressure is applied. In one exemplary embodiment, pressure sensor is a force sensing resistor sensor manufactured by Interlink Electronics, Inc., such as one of the FSR 400 series devices (e.g., part number 30-81794). In one exemplary embodiment, pressure sensor is a force sensing resistor sensor manufactured by Tekscan, Inc., such as the HT201, the A201, or the A401 devices. These types of sensors are thin and flexible enough to be mounted in-between the outer grip material and the inner support structure of the handle 10 (e.g. pressure sensor 15*a*) or steering wheel 5. The same would hold true for the pressure sensors 15*b* located at the hand rest area and for the pressure sensors 15*c* located under the base 32.

In other embodiments and on other user input devices, one or more pressure sensors may be incorporated at other locations where bracing forces from the vessel operator may be detected, such as at other locations in the movable member where forces from the operator's hand or body may be detected. One or more pressure sensors may be located at the base of the movable member to detect forces other than those associated with normal control inputs for controlling steering, shifting, or throttle. For example, pressure sensors may be placed at the connection between the throttle lever 10 and the base 32 to sense forces on the throttle lever in directions and/or patterns indicating that the operator is using the throttle lever 10 to steady themselves in unsteady conditions. Likewise, one or more pressure sensors may be located on the steering shaft 6 to sense forces on the steering wheel in directions and/or patterns other than those associated with inputting normal steering control commands.

In the example of FIGS. 1 and 2, the system 1 includes controller 3, which is programmable and includes a processor 37 and a memory 38. The controller 3 can be located anywhere on the marine vessel 41 and/or located remote from the marine vessel 41 and can communicate with the various components of the system 1 via wired and/or wireless communication links, as will be explained further herein below. Although the examples show a single controller 3, the system 1 may include more than one controller 3. For example, the system 1 may have a controller 3 located at or near a helm of the marine vessel 41 and can also have one or more controllers located at or near the propulsion device 40. The controller 3 may be a dedicated device, or may be incorporated in and a function of a multi-function control device, such as incorporated into a helm control module (HCM) or other control device and software communicatively connected to the ECM 50. Portions of the method disclosed herein below can be carried out by a single controller or by several separate controllers.

In some examples, the controller 3 may be a computing system that includes a processing system, storage system, software, and input/output (I/O) interfaces for communicating with devices in the overall system 1, such as those shown in FIG. 2 and described herein. The processing system loads and executes computer readable instructions from the storage system to detect an unstable condition indicator and operate the variable resistance device 17 as described herein. The computing system may include one or many application modules and one or more processors, which may be communicatively connected. The processing system can comprise a microprocessor (e.g., processor 37) and other circuitry that retrieves and executes software from the storage system. The processing system can be implemented within a single processing device but can also be distributed across multiple processing devices or sub-systems that cooperate in executing program instructions. Non-limiting examples of the processing system include general purpose central processing units, application specific processors, and logic devices.

The storage system (e.g., memory 38) can comprise any storage media readable by the processing system and capable of storing software. The storage system can include volatile and non-volatile, removable and non-removable media implemented in any method or technology for storage of information, such as computer readable instructions, data structures, program modules, or other data. The storage system can be implemented as a single storage device or across multiple storage devices or sub-systems. The storage system can further include additional elements, such as a control circuitry capable of communicating with the processing system. Non-limiting examples of storage media include random access memory, read only memory, magnetic discs, optical discs, flash memory, virtual memory, and non-virtual memory, magnetic sets, magnetic tape, magnetic disc storage or other magnetic storage devices, or any other medium which can be used to store the desired information and that may be accessed by a processing system. The storage media can be a non-transitory or a transitory storage media.

In this example, the controller 3 communicates with each of the one or more components of the system 1 via a communication link 43, which can be any wired or wireless link. The controller 3 is capable of receiving information and/or controlling one or more operational characteristics of the system 1 and its various sub-systems by sending and receiving control signals via the communication links 43. In one example, the communication link 43 is a controller area network (CAN) bus, but other types of links could be used. It should be noted that the extent of connections and the communication links 43 may in fact be one or more shared connections, or links, among some or all of the components in the system. Moreover, the communication links 43 are intended to represent the flow of information in the depicted embodiment, and do not necessarily represent physical or actual links between the devices. Additionally, the system 1 may incorporate various types of communication devices and system, and thus illustrated communication links 43 may in fact represent various different types of wireless and/or wired data communication systems.

Figure 4:
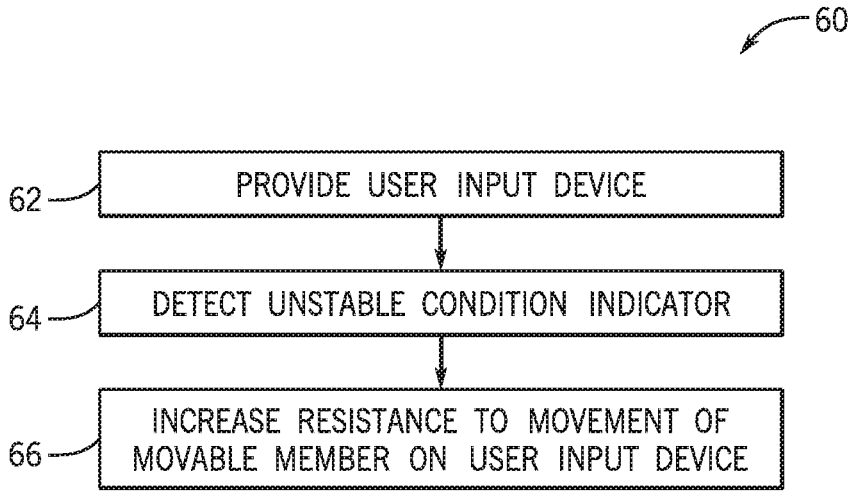
FIG. 4 is a flow diagram depicting one embodiment of a method of providing user input control on a marine vessel.
Figure 5:
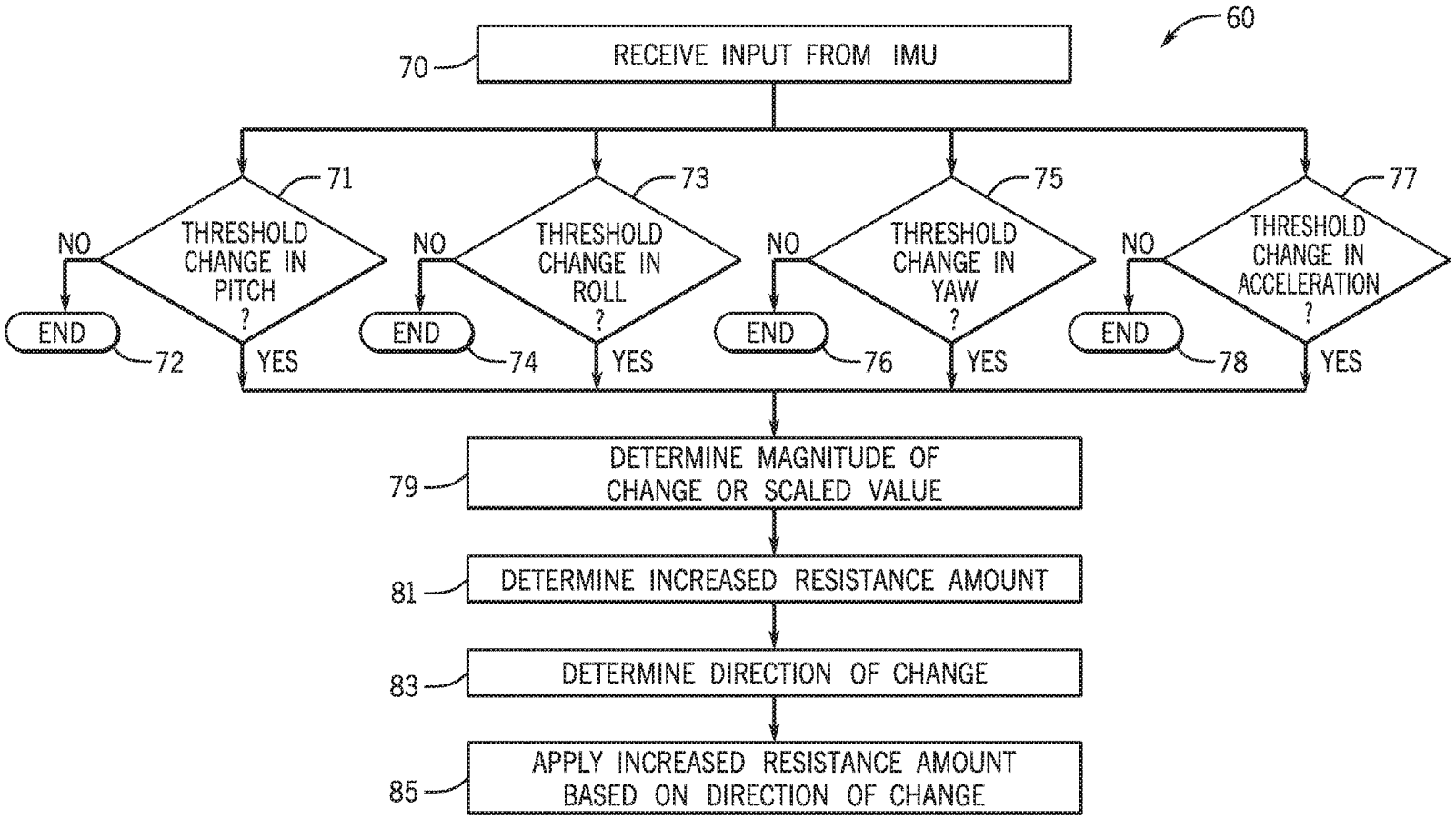
FIG. 5 is a flow diagram depicting another embodiment of a method of providing user input control on a marine vessel.
Figure 6:
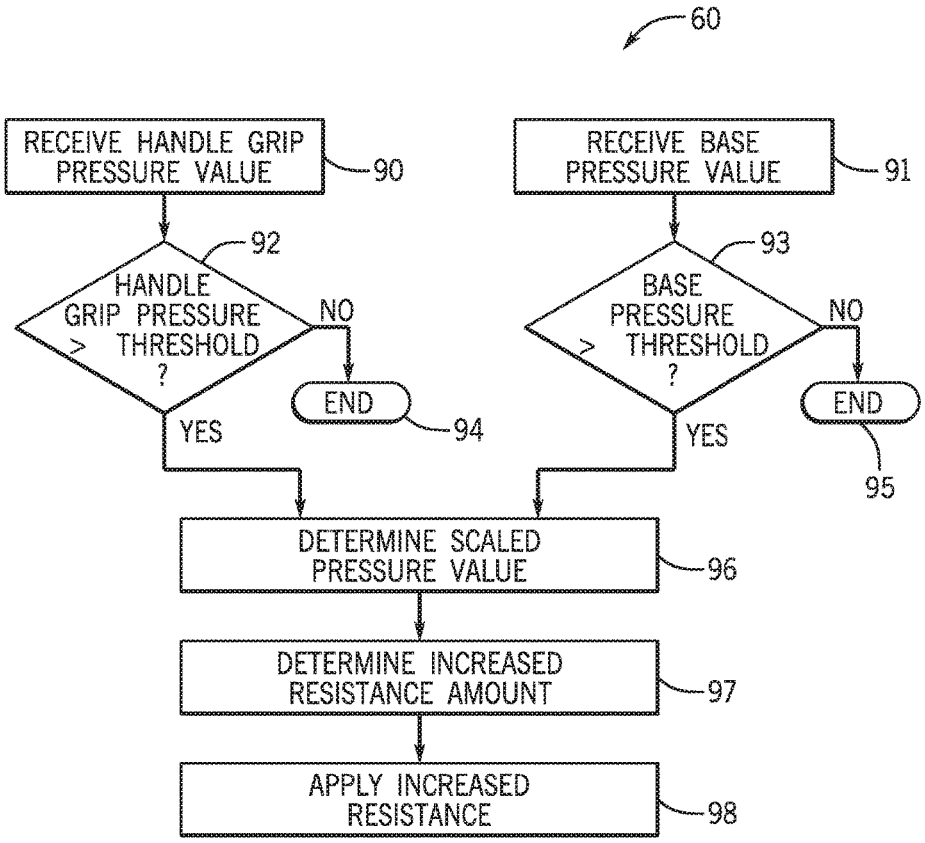
FIG. 6 is a flow diagram depicting another embodiment of a method for providing user input control for a marine vessel.
Figure 7:
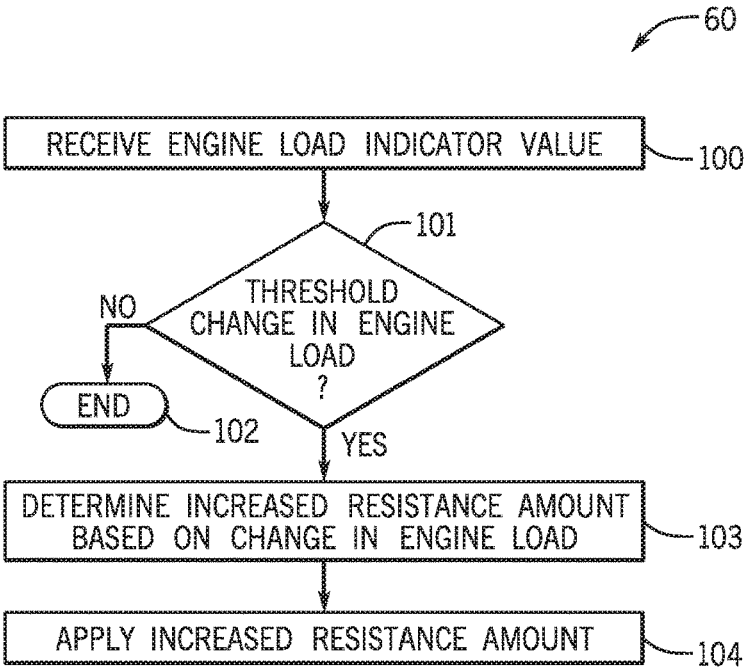
FIG. 7 is a flow diagram depicting another embodiment of a method for providing user input control for a marine vessel.

FIG. 4 is a flow chart depicting one embodiment of a method 60 of providing propulsion and/or steering control for a marine vessel. A user input device is provided at step 62, where the user input device has a movable member that is movable by the vessel operator to control propulsion and/or steering of the marine vessel 41. As described above, the user input device may be any type of user input device providing such control, and incorporates a variable resistance device 17 capable of resisting movement of the movable member. An unstable condition indicator is detected at step 64, and the variable resistance device 17 is controlled to increase resistance to movement of the movable member by the vessel operator at step 66. FIGS. 5-7 exhibit various embodiments of steps that may be executed, such as by the controller 3, to detect the unstable condition indicator and increase resistance accordingly. In various embodiments, one or more of the methods described herein may be executed sequentially or simultaneously for detecting the unstable condition indicator and/or controlling the variable resistance device 17 accordingly.

FIG. 5 depicts another embodiment of a method 60 of providing user input control for a marine vessel. At step 70, the controller 3 receives measurement values from IMU 20. The controller 3 then processes the measurement values to determine whether any of various unstable condition indicators are present. In the example, the controller 3 determines at step 71 whether a threshold change in pitch has occurred. If so, then an unstable condition is indicated; if not, then that assessment produces a negative and is ended at step 72. Step 73 is executed to determine whether a threshold change in roll has occurred on the marine vessel 41. If so, then an unstable condition indicator is found; if not, then that portion of the inquiry is ended at step 74. Likewise, step 75 is executed to determine whether a threshold change in yaw has occurred. If so, then the unstable condition indicator is present; if not, then that indicator is negative and that portion of the inquiry is ended at step 76. Step 77 is executed to determine whether a threshold change in acceleration has occurred, such as a threshold change in acceleration in the horizontal or vertical planes, of a magnitude that would indicate an unstable condition. If no threshold in acceleration has occurred, then that portion of the inquiry is ended at step 78.

For example, the various movement and acceleration thresholds may be experimentally derived for a particular marine vessel configuration based on minimum values that would cause an unstable condition for a vessel operator. If any of the threshold changes has occurred, then an unstable condition indicator is detected and the controller continues to determine how to control the variable resistance device 17 on one or more of the user input devices, such as the steering wheel 5, shift device 7, remote control 9, joystick device 11, foot pedal device 13, or the like. In various embodiments, the resistance may be varied in one, some, or all of the user input devices. For example, resistance may be increased only in user input devices currently in use by the vessel operator, such as user input devices where one or more pressure sensors 15 are detecting pressure exerted by a user or where movement of the user input device is detected by other means.

One or more of the variable resistance devices 17 may be controlled based on the magnitude of the unstable condition indicator, the direction of the unstable condition indicator, or a scaled value determined based on magnitude and/or direction of the unstable condition indicator and accounting for context and/or relative instability indicated by the detected one or more unstable condition indicator values. For example, the scaled value may account for all of the unstable condition indicators that are detected, their magnitudes, and/or their directions, such as to account for the aggregate effect of the combination of changes in pitch, roll, yaw, and/or acceleration detected at steps 71-77. Certain changes may be weighted heavier than others, or certain change combinations may receive more or less weight. Alternatively, step 79 may determine a magnitude of the change, such as the sum of all of the change magnitudes detected, or the largish change magnitude detected.

An increased resistance amount is determined at step 81 based on the change magnitude or scaled value determined at step 79. The increased resistance is then applied, and may be applied to resist movement of the movable member in all directions, or may be applied to resist movement only in certain directions. For example, a direction of the change detected at steps 71-77 may be determined at step 83. Then the variable resistance device 17 may be controlled to apply the increased resistance amount based on the direction of the detected change. For instance, if a change in roll of the marine vessel 41 is detected in the starboard direction, the increased resistance may be applied to resist movement, or to more heavily resist movement, in the starboard direction. For example, such directional application of the resistance amount may be useful as applied to user input devices that control steering, such as the steering wheel 5 and the joystick device 11. With reference to the example of a detected roll in the starboard direction, a variable resistance device 17 in the steering wheel 5 may be controlled to increase resistance more in the starboard turn direction than in the port turn direction. Additionally, the magnitude and/or scaled value may be used to determine which user input devices should be controlled to increase the resistance amount. For example, such determination may be based on the type of user input device and/or its location on the marine vessel. For instance, in a marine vessel 41 having multiple helms, the resistance may be increased more and at lower change magnitudes for user input devices in an upper helm than in a lower helm closer to the center of the marine vessel 41, because the relative change in position, and thus the instability, may be greater in the upper helm than in the lower helm.

FIG. 6 is a flow chart depicting another embodiment of a method 60 of providing user input control for a marine vessel, which is for a user input device having pressure sensors in the handle grip 19 and in the base 32 of the user input device, such as the exemplary remote control 9 shown in FIG. 3. The pressure values are received at the controller 3 and analyzed to determine the appropriate control instructions for the relevant variable resistance device(s) 17. Pressure values from one or more pressure sensors 15*a* in the handle grip 19 are received at step 90. The pressure values are compared to relevant thresholds at step 92 to determine whether the thresholds for detecting an unstable condition indicator are exceeded. Different pressures may be expected, for instance, from the handle grip pressure sensors 15*a* versus the base pressure sensors 15*b*, and thus the relevant thresholds may be different. If the relevant thresholds are not exceeded, then that portion of the inquiry is ended at step 94. If the threshold is exceeded, then an unstable condition indicator has been detected. Likewise, pressure values from one or more pressure sensors 15*b* in a base 32 of the remote control 9 are received at step 91. The pressure values are compared to relevant thresholds at step 93. For example, the thresholds may be set based on the expected pressures from sensors at the relevant sensor locations, whether in the handle grip 19, base 32, or between the base 32 and mounting surface 34.

If the pressure values from one or more of the pressure sensors 15*b* in the base 32 are not exceeded, then that portion of the inquiry is ended at step 95. If any of the relevant thresholds are exceeded at steps 92 or 93 then an unstable condition indicator is found, and the controller 3 then determines an increased resistance amount accordingly. In a depicted example, a scaled pressure magnitude value is determined at step 96 based on the received pressure values. For example, the scaled pressure value may account for the range of pressure values that may be expected from the relevant pressure sensors 15*a* and 15*b*, such as based on their location. To provide just one example, the scaled pressure value may be a value between zero and ten, where a zero is assigned when the pressure value is less than the threshold, a one is assigned when the pressure value is equal to or slightly greater than the relevant threshold, such as the grip handle pressure threshold or the base pressure threshold, and a ten is assigned where the sensed pressure is within a predetermined range of the maximum pressure value that would be expected from the relevant pressure sensor 15*a* or 15*b*. The increased resistance amount is then determined at step 97 based on the scaled pressure value, and the relevant variable resistance device(s) 17 are controlled at step 98 to apply the increased resistance.

FIG. 7 depicts another embodiment of a method 60 of providing user input control for the marine vessel 41. An engine load indicator value is received at step 100, such as a throttle position value from the TP sensor 22, a mass flow rate from the MAF sensor 24, or a manifold absolute pressure value from the MAP sensor 26. The engine load indicator value is compared to a relevant threshold value at step 101 to determine whether a threshold change has occurred. If not, then the inquiry is ended at step 102; however, if a threshold change in engine load has occurred then an unstable condition indicator is found and the controller 3 executes step 103 to determine an increased resistance amount based on the change in engine load. For example, the controller 3 may access a lookup table similar to those exemplified in FIGS. 8A and 8B described below. The relevant variable resistance device(s) 17 are then controlled to apply the increased resistance amount at step 104.

Alternatively or additionally, the engine output torque may be utilized to detect the unstable condition indicator and determine the resistance amount similarly to that described with respect to engine load. For example, the output torque value may be received at the controller 3 from the ECM 50 and compared to a relevant threshold, and then utilized to access a lookup table in order to determine an increased resistance amount.

Figure 8A:
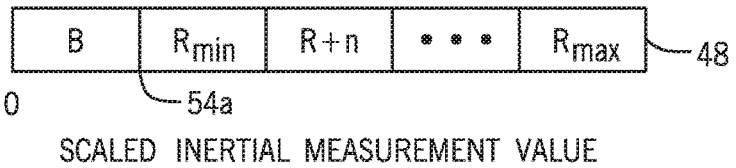
FIGS. 8A and 8B depict exemplary lookup tables providing resistance values for providing user input control.

The increased resistance amount may be determined based on the relevant inputs via lookup tables comparing those inputs to resistance amounts. FIG. 8A exemplifies a lookup table 48 providing increased resistance amounts based on scaled inertial measurement values, such as measured by the IMU 20. For example, a baseline resistance amount B may be provided for the zero scaled value where no threshold change was detected. A minimum increased resistance amount Rmin may be associated with scaled inertial measurement values above a threshold 54*a*. Increasing resistance amount increments R+n may be associated with increasing scaled inertial measurement values up to the maximum amount of resistance Rmax that can be applied by the respective variable resistance device 17. In certain applications, a different lookup table 48 may be provided for each variable resistance device 17 and/or each user input device in the system 1, which may have different thresholds or value ranges for each cell and may contain different resistance amounts (e.g., based on what resistance is necessary for the particular user input device and/or what the particular variable resistance device 17 is capable of).

Figure 8B:
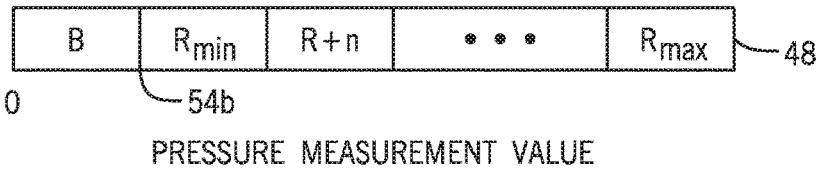

FIG. 8B depicts an exemplary lookup table 48 associating increased resistance amounts with pressure measurement values. As described above, the lookup table 48 may associate a baseline resistance amount where the pressure measurement value is between zero and a threshold value 54*b*, and may associate increased resistance amounts between Rmin and Rmax with various pressure measurement value increments between the threshold amount 54B and a maximum expected pressure measurement value from a given pressure sensor 15 or group of pressure sensors.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A user input device for controlling steering and/or propulsion of a marine vessel, the user input device comprising:

a movable member movable by a vessel operator to control the steering and/or propulsion of the marine vessel;

a variable resistance device controllable to vary resistance to movement of the movable member;

a controller that controls the variable resistance device, the controller configured to:

detect an unstable condition indicator indicating instability of the marine vessel; and control the variable resistance device to increase resistance to movement of the movable member upon detecting the unstable condition indicator.

2. The user input device of claim 1, wherein the controller is further configured to receive measurement values from an inertial measurement unit, and to detect the unstable condition indicator by detecting one or more of a threshold change in pitch, a threshold change in roll, a threshold change in yaw, or a threshold change in acceleration.

3. The user input device of claim 1, wherein the controller is further configured to receive pressure measurement values from a pressure sensor, and to detect the unstable condition indicator by detecting a threshold pressure exerted by the vessel operator on the user input device.

4. The user input device of claim 3, having the pressure sensor in a handle grip of the user input device.

5. The user input device of claim 3, having the pressure sensor in at least one of a base of the user input device or between a base and a mounting surface of the user input device.

6. The user input device of claim 1, wherein the controller is configured to receive an engine load indicator value or an output torque and to detect the unstable condition indicator by detecting a threshold change in engine load or output torque.

7. The user input device of claim 1, wherein the movable member includes least one of a hand-operated throttle lever, a hand-operated shift lever, a foot-operated throttle pedal, a steering wheel, or a joystick.

8. The user input device of claim 7, wherein the variable resistance device includes one of a magnetorheological device, electromagnetic or mechanical contact brake, a direct connected servo motor, a direct connect stepper motor, an electromagnet hysteresis brake, a permanent magnet hysteresis brake, a linear actuator, a mechanical friction slip clutch, or a hydraulic cylinder.

9. The user input device of claim 1, wherein the controller is further configured to determine an increased resistance amount based on a magnitude of the unstable condition indicator.

10. The user input device of claim 9, further comprising a lookup table stored in a memory and accessible by the controller, the lookup table providing increased resistance amount values based on the magnitude of the unstable condition indicator, and wherein the controller is further configured to determine the increased resistance amount by accessing the lookup table based on a magnitude of the unstable condition indicator.

11. The user input device of claim 1, wherein the controller is further configured to determine the increased resistance amount based on a magnitude and a direction of the unstable condition indicator.

12. A method of providing user input control for a marine vessel, the method comprising:

providing a user input device having a movable member movable by a vessel operator to control propulsion and/or steering of the marine vessel, the user input device including a variable resistance device that variably resists movement of the movable member;

detecting an unstable condition indicator indicating instability of the marine vessel; and operating the variable resistance device to increase resistance to movement of the movable member while the unstable condition indicator is detected.

13. The method of claim 12, wherein detecting the unstable condition indicator includes receiving measurement values from an inertial measurement unit and determining whether at least one of a threshold change in pitch, a threshold change in roll, a threshold change in yaw, or a threshold change in acceleration has occurred.

14. The method of claim 12, wherein detecting the unstable condition indicator includes receiving pressure values from a pressure sensor in the user input device and determining whether the vessel operator is exerting a threshold pressure on the user input device.

15. The method of claim 14, wherein the pressure sensor is in at least one of a handle grip of the user input device, a base of the user input device, or between a base and a mounting surface of the user input device.

16. The method of claim 14, further comprising receiving an engine load indicator value or an output torque, and detecting the unstable condition indicator by detecting a threshold change in engine load or output torque.

17. The method of claim 12, wherein the movable member includes is at least one of a hand-operated throttle lever, a hand-operated shift lever, a foot-operated throttle pedal, a steering wheel, or a joystick.

18. The method of claim 12, wherein the variable resistance device includes one of a magnetorheological device, electromagnetic or mechanical contact brake, a direct connected servo motor, a direct connect stepper motor, an electromagnet hysteresis brake, a permanent magnet hysteresis brake, a linear actuator, a mechanical friction slip clutch, or a hydraulic cylinder.

19. The method of claim 12, further including determining an increased resistance amount based on a magnitude of the unstable condition indicator.

20. The method of claim 19, further including accessing a lookup table providing the increased resistance amount based on the magnitude of the unstable condition indicator.

* * * * *